United States Patent [19]

Allen

[11] 4,216,901

[45] Aug. 12, 1980

[54] APPARATUS FOR SAFEGUARDING MONEY

[76] Inventor: Oise R. Allen, 9400 Telstar Dr., Richmond, Va. 23234

[21] Appl. No.: 36,621

[22] Filed: May 7, 1979

[51] Int. Cl.[2] ..... E05G 1/04

[52] U.S. Cl. ..... 232/1 D; 232/44

[58] Field of Search ..... 232/1, 4, 5, 6, 10, 232/11, 12, 13, 14, 15; 248/551, 553, 552, 121, 146, 158

[56] References Cited

U.S. PATENT DOCUMENTS

| | | | |
|---|---|---|---|
| 118,927 | 9/1871 | Grimes | 232/13 |
| 1,754,998 | 4/1930 | Geartts | 248/158 X |
| 1,838,317 | 12/1931 | Marchioni | 232/44 |
| 2,010,877 | 8/1935 | Morell | 109/52 |
| 3,295,755 | 1/1967 | Gold | 232/1 |
| 3,672,563 | 6/1972 | McMath | 232/44 |

*Primary Examiner*—Roy D. Frazier
*Assistant Examiner*—Peter A. Aschenbrenner
*Attorney, Agent, or Firm*—Norman B. Rainer

[57] ABSTRACT

An apparatus is provided for safeguarding tip money left for a waiter or waitress at a restaurant table. The apparatus is comprised of a base having a flat underside, an elongated member extending upwardly from the upper side of said base, harness means associated with the upper extremity of said elongated member, an apertured container engaged by said harness means, and locking means enabling said container to be releasibly secured to said harness means.

2 Claims, 4 Drawing Figures

APPARATUS FOR SAFEGUARDING MONEY

BACKGROUND OF THE INVENTION

This invention relates to the safeguarding of money in a public place and is more particularly concerned with an apparatus adapted to receive and protect tips given to a waiter or waitress in a restaurant.

It is customary for the diner or patron of a restaurant to give money to waiters or waitresses in appreciation for services they render. The money, known as a "tip", is usually a percentage of the total cost of the meal, and is generally left on the table by the patron just prior to leaving the restaurant.

It sometimes happens that other patrons or restaurant employees might steal the tip before the waiter has had an opportunity to retrieve it.

Although collection boxes of well known design might be utilized for safeguarding tip money, such boxes are usually incompatible with the special needs of the waiter or the particular requirements of a restaurant table and restaurant practices.

Because of the occasional spillage of food or drink at the table and the frequent need for cleaning of the table surface, any safebox structure positioned at table height would be subject to fouling and may interfere with cleaning manipulations. If positioned adjacent the periphery of the table where seating means are located, the safebox could constitute an injury—causing hazard to patrons and employees.

It is accordingly an object of this invention to provide a device for the safekeeping of money, said device being adapted for association with a restaurant table in a manner which will not impair the functionability of said table, or interfere with restaurant procedures.

It is a further object to provide a device of the aforesaid nature which will not constitute an injury—causing hazard.

It is a still further object of this invention to provide a device of the aforesaid nature disposed in a manner avoiding susceptability to fouling by food residues.

These objects and other objects and advantages of the invention will be apparent from the following description.

SUMMARY OF THE INVENTION

The above and other beneficial objects and advantages are accomplished in accordance with the present invention by a device comprising a base having a flat underside, an elongated member extending upwardly from the upper side of said base, harness means associated with the upper extreme of said elongated member, an apertured container engaged by said harness means, and locking means enabling said container to be releasibly secured to said harness means.

In preferred embodiments, the upper side of said base is provided with positioning means such as recesses, compartments, or the like to accommodate standard items customarily found on a restaurant table, such as salt and pepper shakers and a sugar container. The base is further adapted to be fastened to the table, as by threaded fasteners, rivets, adhesives, or other fastening means. The elongated member should possess sufficient structural strength to resist forceful breakage or removal from said base.

The harness means is preferably configured so as to provide close-fitting abutment with at least two opposed surfaces of said container. The locking means may be attached to either said harness or said container, and is preferably a key-operated mechanism which controls a moveable latch or equivalent structure capable of establishing a holding relationship between said harness and said container.

The container is provided with a narrow elongated aperture in an upper portion thereof to receive money, and a hinged access door constituting part of the outer periphery of said container and adapted to swing outwardly, away from the interior of said container. Said access door is preferably associated with that portion of said container which is in abutment with said harness means. In further preferred embodiments, the container is provided with a detaining chamber disposed beneath said aperture and behind a transparent window positioned within the front wall of the container. The detaining chamber permits the waiter to see the amount of money left by the patron. A dumping mechanism may be associated with said chamber and operated from outside said container to permit the waiter to cause the tip money to fall downward into the lower region of the container.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DETAILED DESCRIPTION OF THE PREFERRED EMBODIMENT

Figure 1:
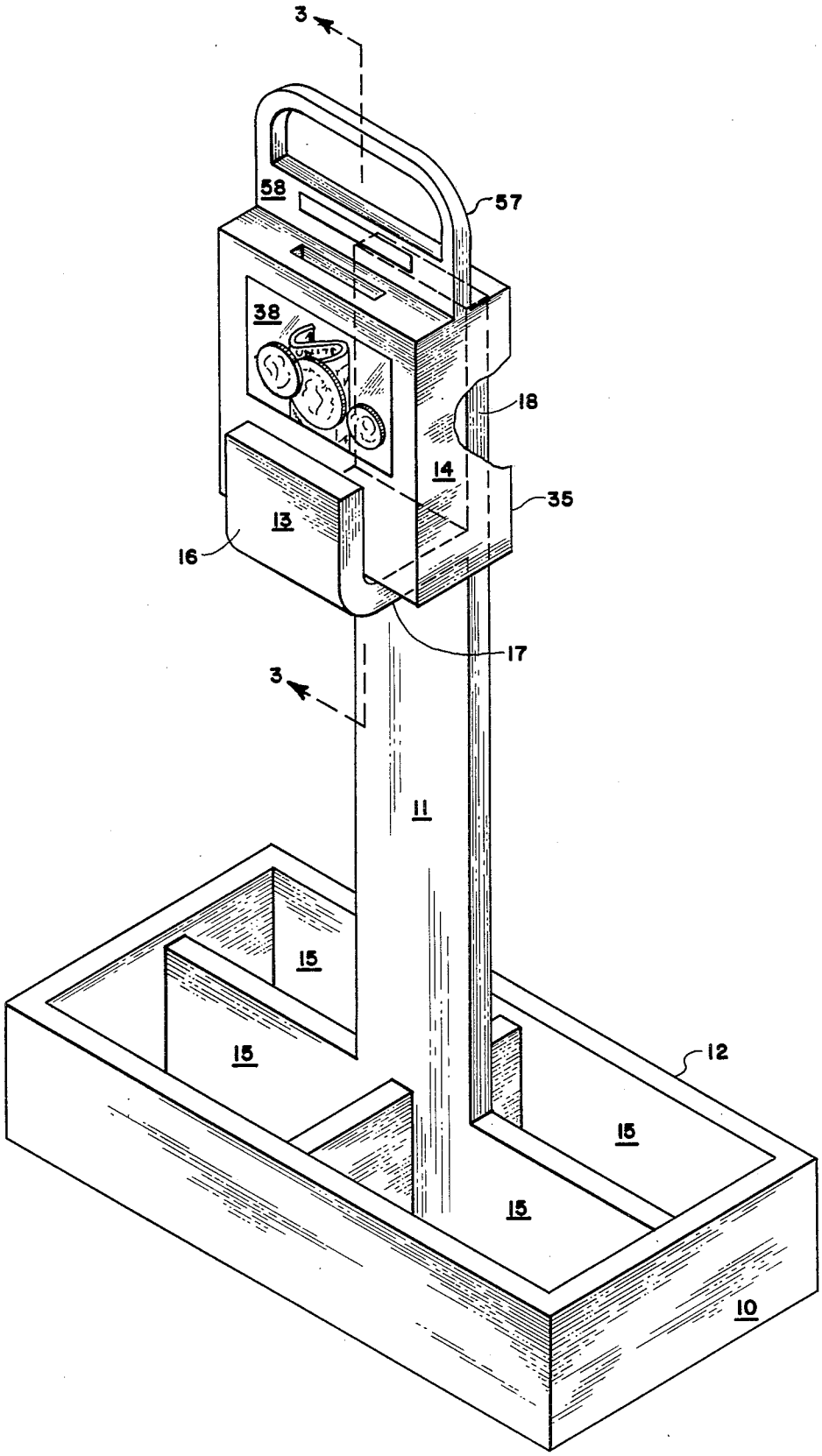
FIG. 1 is a front perspective view of an embodiment of tip safeguarding device of the present invention, partially broken away to reveal additional details.

Referring to FIG. 1, a device of the present invention is shown comprised of a base 10, elongated member 11 extending upwardly from the upper side 12 of said base, harness means 13 disposed at the upper extreme of elongated member 11, and an apertured container 14 engaged by said harness means.

The underside of base 10 is flat. Its upper side is provided with positioning means such as compartments 15 adapted to accommodate standard items customarily found on a restaurant table, such as salt and pepper shakers, a sugar dispenser and containers of other condiments. Although exemplified in a rectangular configuration, the base may have other geometric configurations compatible with its functional requirements.

The elongated member 11 originates at the upper side of base 10 as an integral extension or attachment thereto. When attached to said base, the mode of attachment is preferably one not readily amenable to detachment. For example, if the base and elongated member are fabricated of metal, attachment may be secured via welding, or riveting. If the materials of construction comprise wood or plastics, adhesive bonding techniques may be utilized. The elongated member may be of varied shape but must be sufficiently strong to resist breaking by hand-applied force, and should possess a height of at least about 5 inches.

Figure 2:
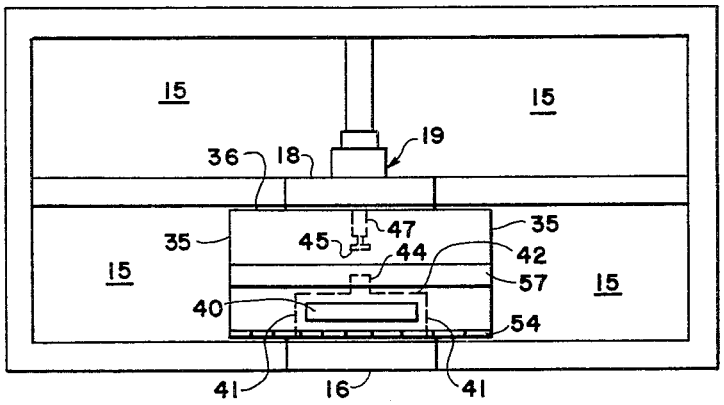
FIG. 2 is a top view of the device of FIG. 1.
Figure 3:
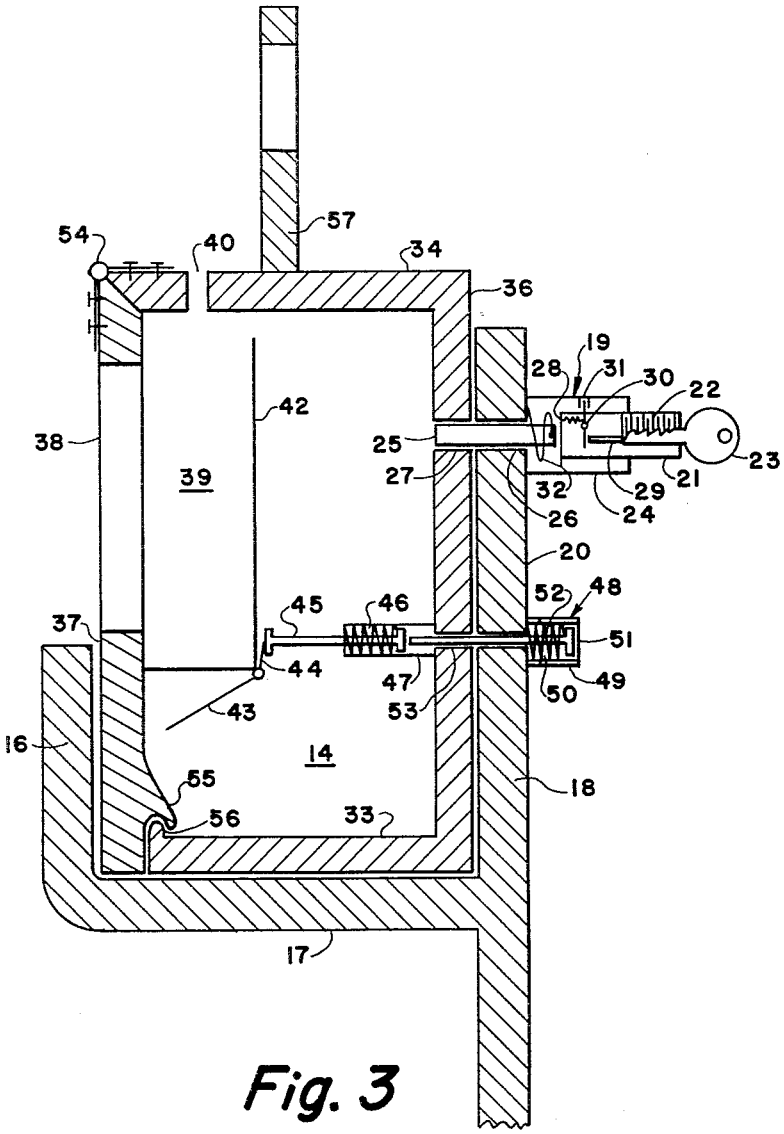
FIG. 3 is an enlarged fragmentary sectional view taken along the lines 3—3 of FIG 1.
Figure 4:
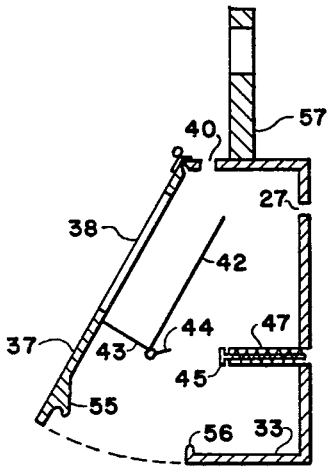
FIG. 4 is a sectional side view of the container member of the embodiment of FIG. 1 shown with its access door swung open.

The embodiment of harness means 13 exemplified in FIG. 1 is constructed as an integral extension of elongated member 11 and comprised of front wall 16, saddle 17 and rear wall 18. A locking means 19, shown in FIGS. 2 and 3, is mounted on the rear face 20 of rear wall 18. Said locking means is comprised of cylinder 21 containing spring-loaded tumblers 22 which accomodate key 23, tubular alignment housing 24, and latch bolt 25 adapted to be pushed into aligned holes 26 and 27 in rear wall 18 and apertured container 14 respectively by the forward end 28 of cylinder 21. In the exemplified locking mechanism, a push rod 29, when urged forward by key 23, displaces pivoted lever 30 to an upright position. Forward motion of the key and rotative motion of cylinder 21 causes upright lever 30 to engage with bifurcated detent 31 while concommittantly pushing latchbolt 25 forward into hole 27. Additional mechanism is provided to prevent rotation of cylinder 21 when the key is removed therefrom. In unlocking, the cylinder is rotated in the opposite direction, and return spring 32 causes latchbolt 25 to exit from hole 27 and simultaneously restore cylinder 21 to the outermost position.

The specific construction of locking means 19 is not a part of this invention, and in fact any well known commercially availably locking means may be utilized. The sole requirement of said locking means is that it causes apertured container 14 to become immoveably retained by harness means 13. Although the locking principle exemplified in the drawings involves insertion of a latchbolt through a hole in apertured container 14, other locking principles may be utilized wherein, for example, apertured container 14 may have a protuberance instead of a hole for engagement with a locking means. The locking means may also be associated with the apertured container, whereby a latchbolt or equivalent member is made to engage with harness means 13.

The embodiment of apertured container 14 exemplified in the drawings is a box-like six-sided structure comprised of a bottom member 33, top member 34, opposed identical side walls 35, rear panel 36, and front panel 37 pivotally attached at its upper extremity to the forward edge of top member 34 and adapted to function as an access door. In the illustrated preferred embodiment, front panel 37 is provided with a window 38 and a detaining chamber 39 attached to the inside face of front panel 37 behind window 38 and below elongated slot 40 in top member 34.

Detaining chamber 39 is comprised of vertical side members 41 joined to vertical back member 42, and bottom closure 43 pivotally supported by the bottom of back member 42 and normally maintained in horizontal disposition by spring means not shown. A control lever 44 is rigidly connected to the supported edge of bottom closure 43 at the center thereof and angled upwardly. A plunger 45 associated with restoring spring 46 confined within housing 47 mounted to the inside face of rear wall 36 is adapted to contact lever 44 to cause downward movement of bottom closure 43. Such downward movement of bottom closure 43 causes the contents of detaining chamber 39, namely coins and folded paper money, to fall to the bottom of apertured container 14. Activation of plunger 45 is achieved by plunger control means 48 mounted on the rear of rear wall 18 and comprised of a depressable shell 49, a guide sleeve 50, and an extension rod 51 and restoring spring 52 positioned within said guide sleeve. In operation, depression of depressable shell 49 urges extension rod 51 through channel 53 in rear panel 36 to displace plunger 45 forwardly into contact with control level 44. Forward movement of said control lever causes bottom closure 43 to swing downwardly, as shown in FIG. 3, enabling discharge of the contents of detaining chamber 39. Other equivalent means for controllably emptying detaining chamber 39 may be employed.

Front panel 37 of apertured container 14 is adapted to swing outwardly, away from the interior of said container, by appropriate positioning of hinge means 54 adjacent the upper extremity of said front panel and the forward extremity of top member 34. The bottom of said front panel is adapted to abut against bottom member 33. Retaining means may be provided at the lower extremity of front panel 37 whereby said panel engages with said bottom member. Said retaining means may comprise a grooved shoulder 55 in front panel 37 adapted to interact with an upraised boss 56 in said bottom member. Front panel 37 is designed in such a manner with relationship to harness means 13 that said panel is immobilized when positioned within said harness means. Front wall 16 of said harness means is lower in height than rear wall 18 so as not to occlude window 38 of the apertured container. A handle 57 is affixed to the top member 34 of said apertured container. The front face 58 of said handle may be provided with means for holding a nameplate and may contain printed indicia. Alignment means may be provided to facilitate the positioning of apertured container 14 in engagement with harness means 13 in a manner such that latchbolt 25 is automatically aligned with hole 27 in rear panel 36 of said apertured container.

In operation, the waiter or waitress will place the apertured container in position in said harness means and secure it in place by locking means 19. After each patron deposits a tip through slot 40, the waiter or waitress will empty detaining chamber 39 by pressing depressable shell 49. At the end of his or her work shift, the apertured container will be released from locked engagement with said harness means, and lifted by handle 57. Front panel 37 will then be swung open to permit removal of the money held within the container. This mode of operation of the device of this invention enables the apertured container to be released from its holding harness and opened with just one manipulation of a locking means.

The device of the present invention is constructed throughout to possess a sturdiness capable of resisting deliberate breakage and/or theft. The base may be secured to the table by known means to thwart its removal from said table. The embodiment of the device exemplified in the drawings will generally be positioned on a table adjacent one end thereof. Other embodiments may be designed for central positioning on a table, in which case the apertured container and coacting harness means may be made to have a bilateral symmetry having two opposed front panels.

While particular examples of the present invention have been shown and described, it is apparent that changes and modifications may be made therein without departing from the invention in its broadest aspects. The aim of the appended claims, therefore, is to cover all such changes and moficications as fall within the true spirit and scope of the invention.

Having thus described my invention, what is claimed is:

1. A device for safeguarding money comprising a base having a flat underside adapted for durable attachment to the upper surface of a table and an upper side provided with positioning means to accommodate standard items customarily found on a restaurant table, an elongated member extending upwardly from said base, harness means associated with the upper extremity of said elongated member, a container having a narrow elongated aperture located in an upper portion thereof, said container being engaged by said harness means and having a hinged access door adapted to swing outwardly away from the interior of said container and further adapted to fit in abutment with said harness means, a detaining chamber disposed within said container beneath said aperture and behind a transparent window positioned within the periphery of said container, said detaining chamber being provided with bottom closure means capable of movement to cause downward discharge of the contents of said chamber, said movement being controlled by means outside said container, and key operated locking means causing said container to be retained by said harness, whereby with a single unlocking manipulation said container can be removed from said harness means and the hinged access door can be opened to permit removal of the contents of said container.

2. The device of claim 1 wherein said detaining chamber is attached to said hinged access door.

* * * * *